US006231368B1

(12) United States Patent
Murakami et al.

(10) Patent No.: US 6,231,368 B1
(45) Date of Patent: May 15, 2001

(54) HALF-FITTING PREVENTION CONNECTOR

(75) Inventors: Takao Murakami; Masaru Fukuda, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/591,673

(22) Filed: Jun. 12, 2000

(30) Foreign Application Priority Data

Jun. 11, 1999 (JP) ..... 11-165539

(51) Int. Cl.[7] ..... H01R 13/627
(52) U.S. Cl. ..... 439/352
(58) Field of Search ..... 439/159, 350–358, 439/419

(56) References Cited

U.S. PATENT DOCUMENTS 6,019,629 * 2/2000 Ito et al. ..... 439/352
6,059,597 * 5/2000 Endo et al. ..... 439/352
6,095,843 * 8/2000 Kaneka et al. ..... 439/352
6,135,802 * 10/2000 Nakamara ..... 439/352

FOREIGN PATENT DOCUMENTS 5-81967 11/1993 (JP) ..... H01R/13/639
10-289756 10/1998 (JP) ..... H01R/13/64

* cited by examiner

*Primary Examiner*—Hien Vu
(74) *Attorney, Agent, or Firm*—Sughrue, Mion, Zinn, Macpeak & Seas, PLLC

(57) ABSTRACT

In a half-fitting prevention connector (200), a slider (10) positively prevents a half-fitted condition of a pair of connectors by a resilient force of compression springs (9) received in a housing (3) of the male connector (1), and the slider is received in this housing, and when the male connector is to be fitted relative to the female connector (2), the slider cooperates with the compression springs (9) to move between a lock position where the slider holds a lock arm (6), provided in the housing (3), in retained relation to a housing (21) of the female connector (2) and a non-lock position. The lock arm (6) has a lock projection (7) for retaining the slider (10) in the lock position against the resilient force of the compression springs (9). A buffer mechanism (40) is provided at the housing (3), and during returning movement of the slider (10) from the non-lock position to the lock position by the resilient force of the compression springs (9), the buffer mechanism abuts against the slider (10) before the lock projection (7) abuts against the slider, so as to absorb an impingement energy by an elastic deformation thereof.

2 Claims, 11 Drawing Sheets

HALF-FITTING PREVENTION CONNECTOR

BACKGROUND OF THE INVENTION

1. Field of the Invention

The present invention relates to a half-fitting prevention connector in which a slider, mounted on at least one of a pair of connectors to be fittingly connected together, positively prevents a half-fitted condition of the two connectors by a resilient force of spring members, and also the slider can positively lock the connector to the mating connector in a fitted condition.

The present application is based on Japanese Patent Application No. Hei. 11-165539, which is incorporated herein by reference.

2. Description of the Related Art

Usually, various electronic equipments are mounted on a vehicle such as an automobile, and therefore, naturally, various types of female and male connectors are provided at connection ends of various kinds of wires forming wire harnesses or the like.

Various half-fitting prevention connectors, capable of detecting a half-fitted condition of the female and male connectors, have been used, and one half-fitting prevention connector is disclosed in Unexamined Japanese Utility Model Publication No. Hei. 5-81967.

This half-fitting prevention connector comprises a pin-type connector, having a plurality of juxtaposed pin contacts mounted therein, and a socket-type connector having a plurality of juxtaposed socket contacts mounted therein. A movable cover is mounted on the outer periphery of the female connector for movement back and forth. Spring receiving portions are provided at opposite side portions of this movable cover, respectively, and spring members are received respectively in these spring receiving portions, and extend in a forward-rearward direction.

In this half-fitting prevention connector, however, although a half-fitted condition can be prevented by the resilient force of the spring members, there is encountered a problem that when trying to fit the two connectors together while holding the opposite side surfaces of the movable cover with the hand, the movable cover can not be moved, and therefore the efficiency of the fitting operation is low.

Therefore, various half-fitting prevention connectors for solving the above problem have been proposed. FIGS. 10 to 13 show a half-fitting prevention connector 100 disclosed in Unexamined Japanese Patent Publication No. Hei. 10-289756.

As shown in FIG. 10, this half-fitting prevention connector 100 comprises a pair of male and female connectors 1A and 2 to be fittingly connected together.

The male connector 1A comprises a housing 3A which includes an inner housing 3*a* having terminal receiving chambers 17 for respectively receiving a predetermined number of (two in the illustrated example) socket contacts 31. A slider receiving portion 4 for slidably receiving a slider 10 (described later) is formed above the inner housing 3*a*, and an outer housing, serving as a hood portion 19, covers the outer periphery of the inner housing 3*a*, with a suitable space formed therebetween, the outer housing forming the slider receiving portion 4.

Side rib-receiving portions 19*a* for respectively receiving side ribs 27 (described later) of the female connector 2 are formed in an inner surface of the hood portion 19, and extend in a fitting direction.

Guide grooves 5 for respectively guiding opposite side portions of a slider body 11 are formed respectively at opposite side portions of the slider receiving portion 4, and tubular spring receiving portions 3*c* are formed respectively at rear ends of the guide grooves 5. A lock arm 6 of the cantilever type is formed integrally at a central portion of the slider receiving portion 4, and extends in the fitting direction, and a free end (distal end) portion of this lock arm 6 can be elastically displaced in an upward-downward direction.

A lock projection 7, having a slanting surface 7*b*, is formed on an upper surface of the lock arm 6, and a housing lock 8 for retaining engagement with a female housing 21 (described later) is formed on a lower surface of the lock arm 6 at the distal end thereof. Displacement prevention projections 8*a* for preventing the displacement of the lock arm 6 are formed integrally on the upper surface of the lock arm 6, and face away from the housing lock 8. Side spaces 4*a* for respectively receiving abutment projections 14 of the slider 10 (described later) are provided at opposite sides of the lock arm 6, respectively.

As shown in FIG. 10, the slider 10 has an elastic slider arm 12 of the cantilever type provided at a generally central portion of the slider body 11, and the pair of abutment projections 14 are formed respectively on opposite side portions of a lower surface of the slider arm 12 at a front end thereof. The slider 10 includes a pressing portion 15, which is operated when canceling the fitting connection, a slide groove 13 formed in the slider arm 12 and the pressing portion 15, and a pair of spring retaining portions 16 which are formed respectively at opposite side portions of a lower rear portion of the slider, and retain a pair of compression springs (spring members) 9 and 9, respectively.

As shown in FIG. 11, the female connector 2 includes terminal receiving chambers 29 (each in the form of a through hole) for respectively receiving a predetermined number of (two in the illustrated example) pin contacts 32, and this female connector has a housing insertion port 26 open to the front end thereof. A pair of stopper projections 22 are formed on the upper surface of the housing 21, and these projections 22 abut respectively against the abutment projections 14 of the slider 10 when the connectors are fitted together. An engagement projection 23 for retaining the housing lock 8 is formed between the stopper projections 22 and 22, and this engagement projection 23 has a slanting surface for flexing (elastically deforming) the lock arm 6 of the male connector 1A when the lock arm 6 is brought into engagement with the engagement projection 23. A bracket 28 for mounting on an associated member is formed on the housing 21, and is disposed at the lower side of the housing insertion port 26.

First, as shown in FIG. 11, when the slider 10, having the compression springs 9 retained respectively by the spring retaining portions 16, is inserted into the slider receiving portion 4 from the front side of the male connector 1A, the slider body 11 is moved rearward along the guide grooves 5. At this time, the abutment projections 14, formed on the lower surface of the slider arm 12, are received respectively in the side spaces 4*a* provided respectively at the opposite sides of the lock arm 6.

Then, the compression springs 9 are received in the spring receiving portions 3*c*, respectively, and also the lock projection 7 is fitted in the slide groove 13, so that the slider 10 is supported on the housing 3A so as to move between a lock position and a non-lock position. In the non-lock position of the slider 10, the slider 10 is disposed at a proximal end-side of the lock arm 6 to allow the elastic deformation of the lock arm 6 when the lock arm 6 is brought into and out of engagement with the mating housing. In the lock position, the slider 10 is disposed at a distal end-side of the lock arm 6 to prevent the elastic deformation of the lock arm 6.

In the slider-mounted condition, the slider 10 is urged forward (that is, to the lock position) by the resilient force of the compression springs 9 as shown in FIG. 11, and a rear end 13*a* of the slide groove 13 is engaged with the lock projection 7 in the slide groove 13, and also the displacement prevention projections 8*a* at the distal end of the lock arm 6 are abutted against a displacement prevention portion 11*a* of the slider 10, thereby preventing upward elastic displacement of the lock arm 6.

Then, the socket contacts 31 are inserted respectively into the terminal receiving chambers 17 open to the rear end of the housing 3A of the male connector 1A, and these contacts 31 are retained respectively by housing lances formed respectively within the terminal receiving chambers 17. The pin contacts 32 are inserted respectively into the terminal receiving chambers 29 open to the rear end of the housing 21 of the female connector 2, and these contacts 32 are retained respectively by housing lances formed respectively within the terminal receiving chambers 29.

Then, when the male and female connectors 1A and 2 begin to be fitted together as shown in FIG. 12, the stopper projections 22 of the female connector 2 are inserted respectively into the side spaces 4*a* (see FIG. 10) provided respectively at the opposite sides of the lock arm 6 of the male connector 1A, and these stopper projections 22 abut respectively against the abutment projections 14 of the slider 10, and when the female connector 2 is pushed, the compression springs 9 are compressed to produce a resilient force.

Then, when the fitting operation further proceeds, the slider 10 is pushed rearward (right in FIG. 12) against the bias of the compression springs 9, and the housing lock 8 at the distal end of the lock arm 6 engages the engagement projection 23 of the female connector 2. If the pushing operation is stopped in this half-fitted condition, the male and female connectors 1A and 2 are pushed back away from each other in their respective disengaging directions (opposite to their respective fitting directions) by the resilient force of the compression springs 9, so that this half-fitted condition can be easily detected.

Then, when the fitting operation further proceeds as shown in FIG. 13, the slider arm 12 of the slider 10 is elastically deformed upwardly by the slanting surface 7*b* of the lock projection 7, so that the abutting engagement of each stopper projection 22 with the associated abutment projection 14 of the slider 10 is canceled. Then, the housing lock 8 at the distal end of the lock arm 6 slides over the engagement projection 23, and is retained by this projection 23 while the slider arm 12, disengaged from the stopper projections 22, is returned to the lock position by the resilient force of the compression springs 9.

When the slider 10 is returned to the lock position by the resilient force of the compression springs 9, the displacement prevention portion 11*a* of the slider 10 abuts against the displacement prevention projections 8*a* of the lock arm 6, as shown in FIG. 13. Therefore, the elastic deformation of the lock arm 6 is prevented, thus achieving a double-locked condition in which the cancellation of the engagement between the lock arm 6 and the engagement projection 23 is prevented by the slider 10. In this condition in which the cancellation of the engagement of the lock arm 6 is prevented by the slider 10, the male and female connectors are in a completely-fitted condition, and the contacts 31 are completely connected to the contacts 32, respectively.

This completely-fitted condition can be detected through the sense of touch obtained when the housing lock 8 slides over the engagement projection 23, and also this completely-fitted condition can be easily confirmed by viewing the position of the returned slider 10.

In the above conventional half-fitting prevention connector 100, when the slider 10 is returned to the lock position, an abutment surface 7*a* of the lock projection 7, formed on the lock arm 6, abuts against the rear end 13*a* of the slide groove 13 in the slider 10, thereby limiting the forward displacement of the slider 10, as shown in FIG. 13.

Therefore, all of the resilient forces of the compression springs 9 serve as a force of impingement of the slider 10 on the lock projection 7 on the housing 3A. Therefore, there have been encountered problems that the excessive force acts on the lock projection 7, and that a large impingement sound and impact vibration due to the impingement of the slider 10 on the lock projection 7 are produced when the slider 10 is returned, which is unpleasant.

SUMMARY OF THE INVENTION

It is therefore an object of the present invention to provide an improved half-fitting prevention connector in which undue impingement of a slider on a housing is prevented at the time of returning movement of the slider, thereby reducing unpleasant impingement sound and impact vibration due to the impingement.

To achieve the above object, according to the first aspect of the present invention, there is provided a half-fitting prevention connector which comprises a first connector housing having a lock arm formed therein, the lock arm including a lock projection, a second connector housing fittable to the first connector housing, a resilient member attachable into the first connector housing, a slider insertable into the first connector housing, the slider preventing a half-fitted condition of the first and second connector housings by a resilient force of the resilient member, wherein when the first and second connector housings are fitted to each other, the slider cooperates with the resilient member to move between a lock position where the slider holds the lock arm in retained relation to the second connector housing and a non-lock position, and the lock projection of the lock arm retains the slider in the lock position against the resilient force of the resilient member, and an elastic buffer mechanism provided at the first connector housing, wherein, during returning movement of the slider from the non-lock position to the lock position by the resilient force of the resilient member, the buffer mechanism abuts against the slider before the lock projection abuts against the slider, so as to absorb an impingement energy by an elastic deformation thereof.

In the above construction, during the returning movement of the slider from the non-lock position to the lock position by the resilient force of the spring member in the connector fitting operation, the slider abuts against the buffer mechanism before the slider abuts against the lock projection on the lock arm, so as to absorb an impingement energy by the elastic deformation of the buffer mechanism.

Therefore, when the slider subsequently abuts against the lock projection on the lock arm, the impingement is gentle since the impingement energy has been absorbed, and an excessive force is prevented from acting on the lock projection, and a large impingement sound and impact vibration due to the impingement can be reduced.

Further, according to the second aspect of the present invention, it is preferable that the buffer mechanism includes buffer projections formed on and projecting respectively from slider-sliding surfaces which are formed in the first connector housing, and on which the slider is slidable, each of the buffer projections having a slanting surface for abutting engagement with the slider, and retraction openings formed adjacent respectively to rear sides of the buffer projections so as to allow the buffer projections to be elastically retracted rearwardly respectively from the slider-sliding surfaces to allow the movement of the slider.

In this construction, the buffer projections, formed respectively on the slider-sliding surfaces, can be elastically retracted rearwardly respectively from the slider-sliding surfaces, and therefore the amount of elastic deformation of the buffer projections can be increased, and also the slider can be easily inserted and mounted in the first connector housing.

DETAILED DESCRIPTION OF THE PREFERRED EMBODIMENTS

One preferred embodiment of a half-fitting prevention connector of the present invention will now be described in detail with reference to FIGS. 1 to 8.

Figure 10:
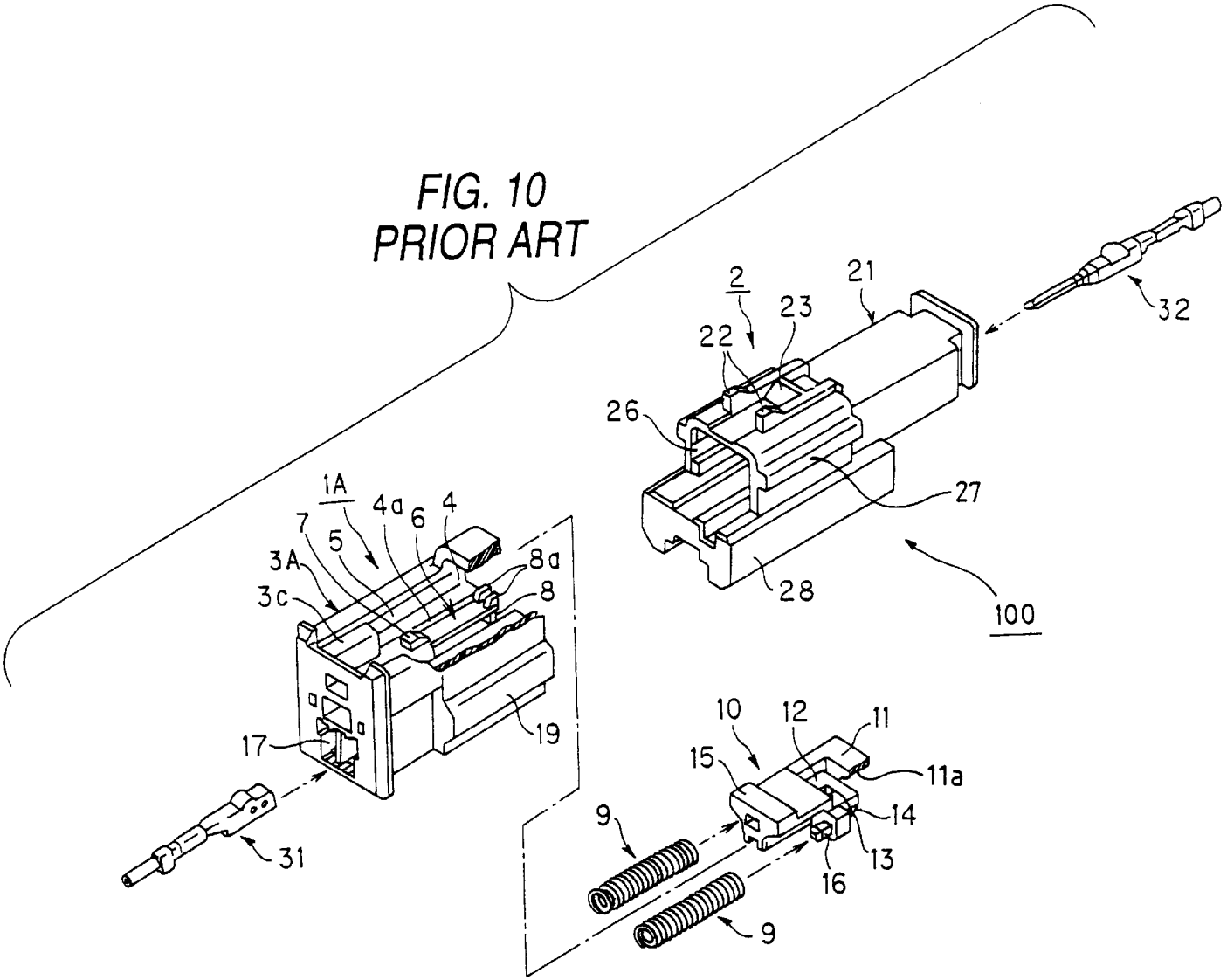
FIG. 10 PRIOR ART
FIG. 10 is an exploded, perspective view of a conventional half-fitting prevention connector.
Figure 11:
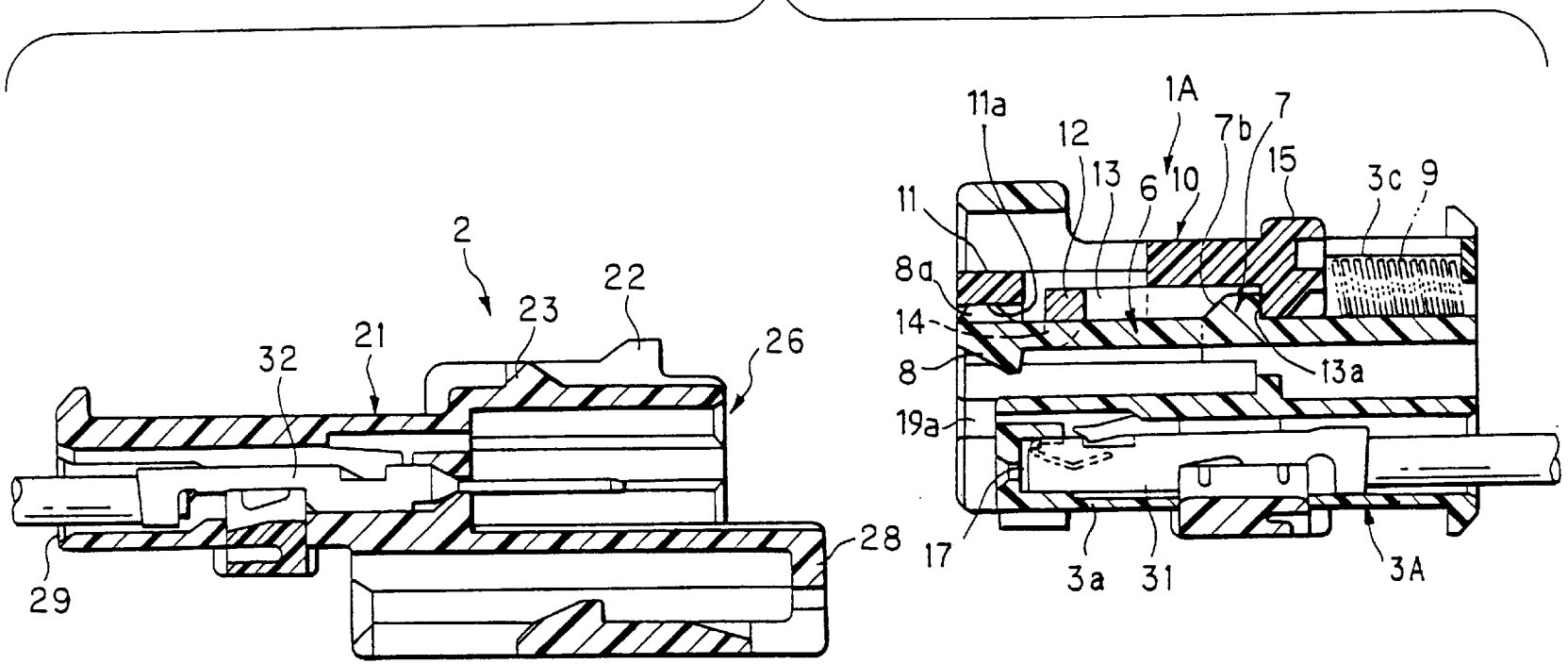
FIG. 11 PRIOR ART
FIG. 11 is a vertical cross-sectional view showing the procedure of assembling the conventional half-fitting prevention connector of FIG. 10.
Figure 12:
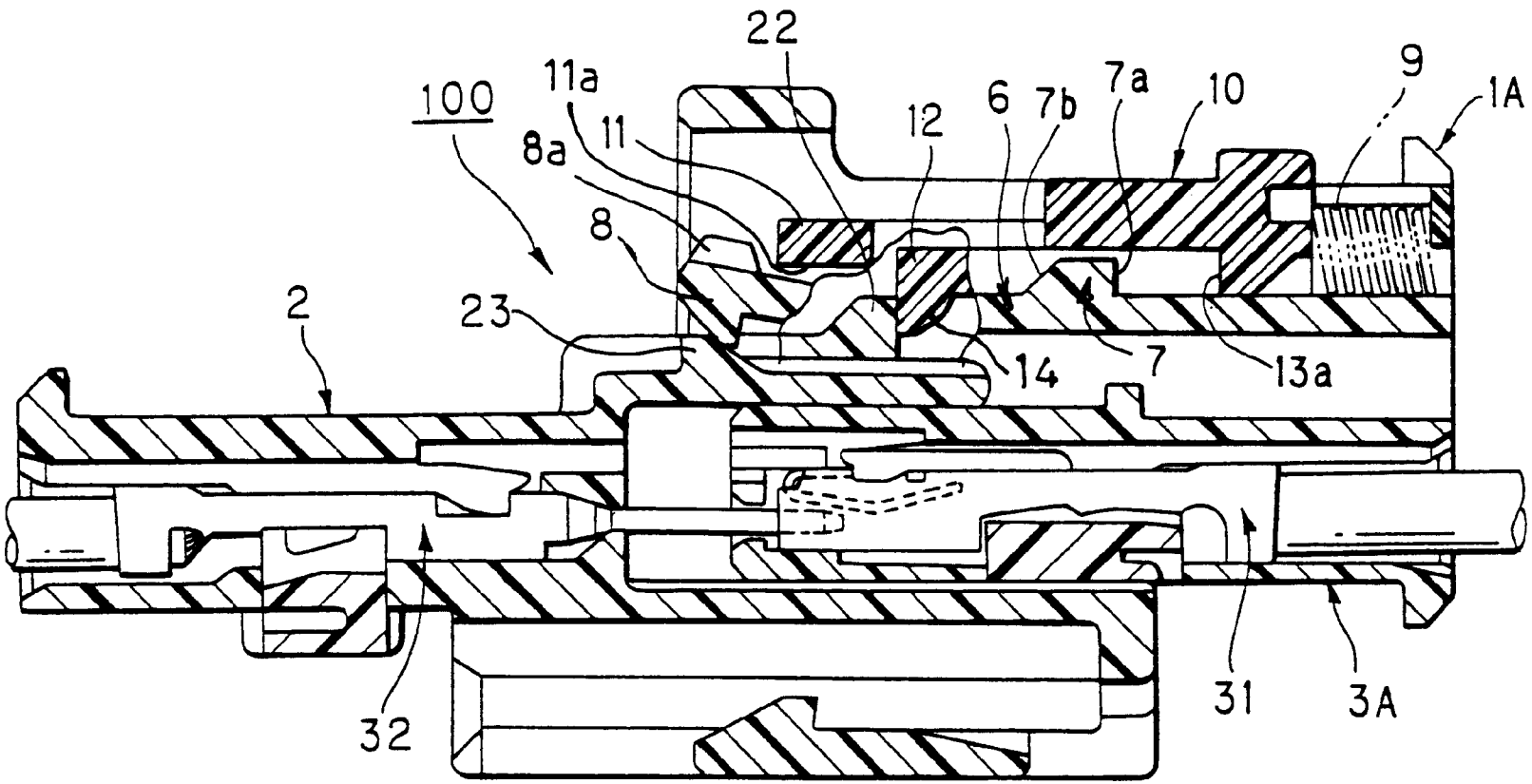
FIG. 12 PRIOR ART
FIG. 12 is a vertical cross-sectional view of the conventional half-fitting prevention connector of FIG. 10 in a half-fitted condition.
Figure 13:
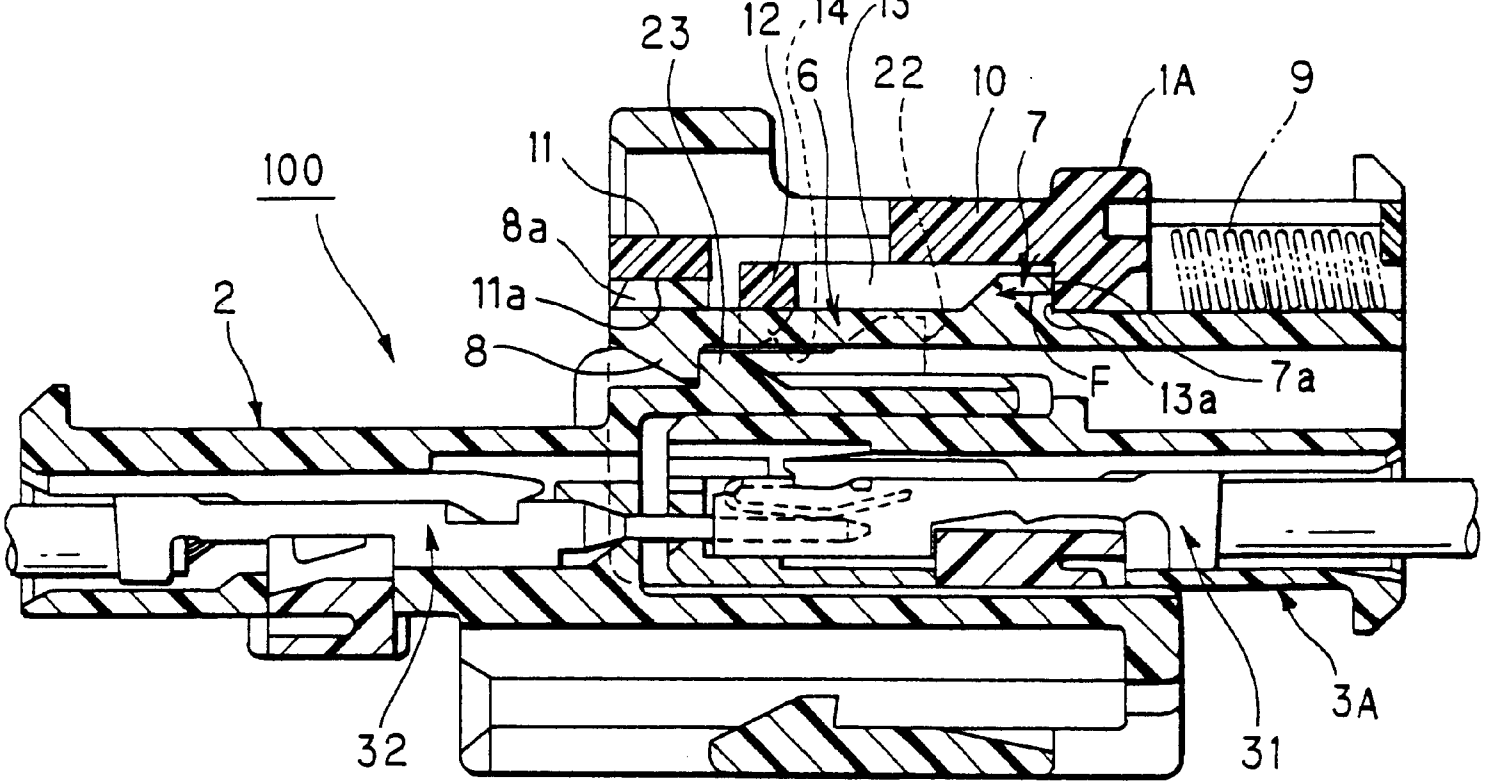
FIG. 13 PRIOR ART
FIG. 13 is a vertical cross-sectional view of the conventional half-fitting prevention connector in a completely-fitted condition.

Like the half-fitting prevention connector 100 of FIG. 10, the half-fitting prevention connector 200 of this embodiment comprises a pair of male and female connectors 1 and 2 to be fittingly connected together.

Figure 1:
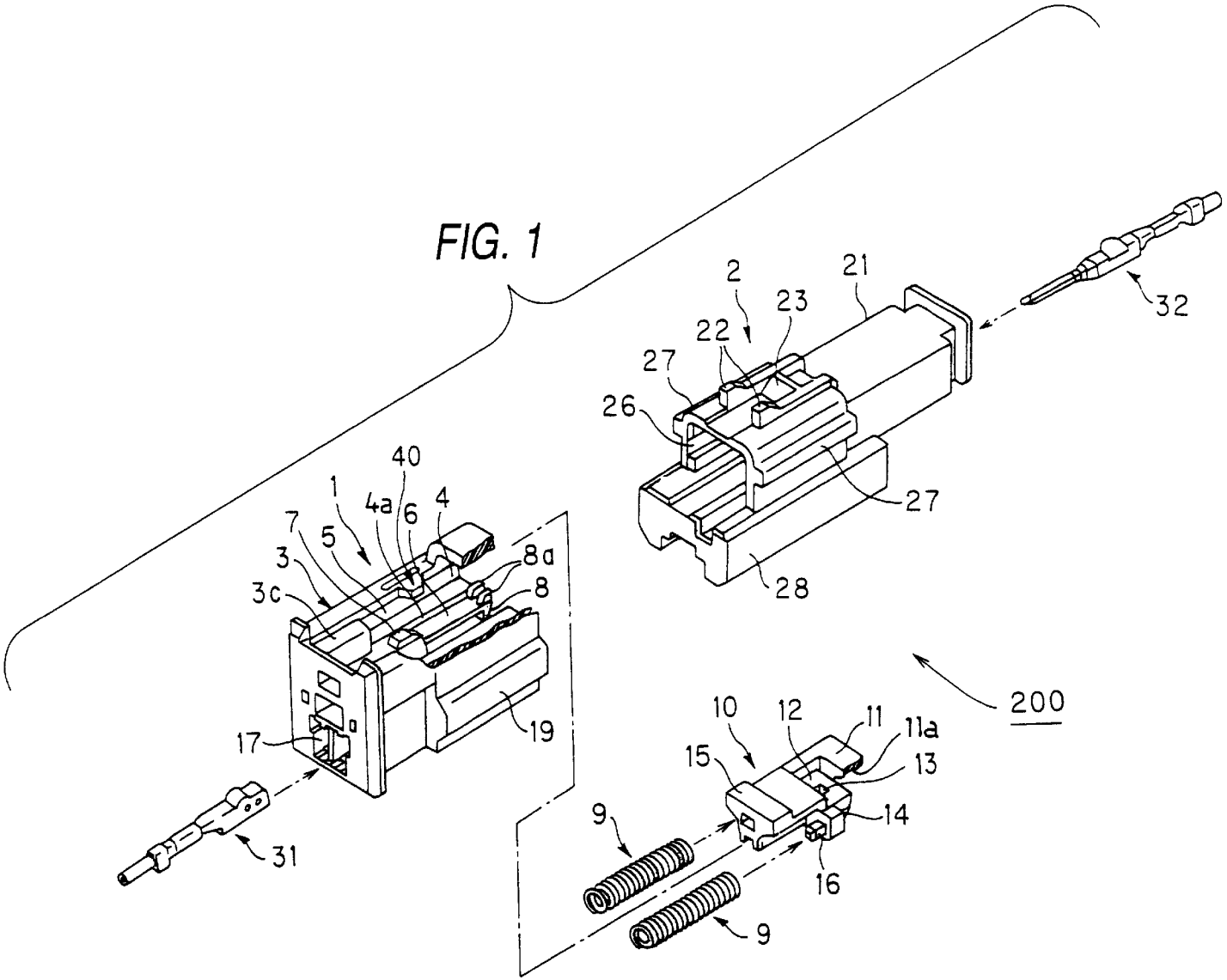
FIG. 1 is an exploded, perspective view of one preferred embodiment of a half-fitting prevention connector of the present invention.

As shown in FIG. 1, the male connector 1 comprises a housing 3 which includes an inner housing 3*a* having terminal receiving chambers 17 for respectively receiving a predetermined number of (two in the illustrated example) socket contacts 31. A slider receiving portion 4 for slidably receiving a slider 10 is formed above the inner housing 3*a*, and an outer housing, serving as a hood portion 19, covers the outer periphery of the inner housing 3*a*, with a suitable space formed therebetween, the outer housing forming the slider receiving portion 4.

Side rib-receiving portions 19*a* for respectively receiving side ribs 27 (described later) of the female connector 2 are formed in an inner surface of the hood portion 19, and extend in a fitting direction.

Guide grooves 5 for respectively guiding opposite side portions of a slider body 11 are formed respectively at opposite side portions of the slider receiving portion 4, and tubular spring receiving portions 3*c* are formed respectively at rear ends of the guide grooves 5. A lock arm 6 of the cantilever type is formed integrally at a central portion of the slider receiving portion 4, and extends in the fitting direction, and a free end (distal end) portion of this lock arm 6 can be elastically displaced in an upward-downward direction.

A lock projection 7, having a slanting surface 7*b*, is formed on an upper surface of the lock arm 6, and a housing lock 8 for retaining engagement with a female housing 21 (described later) is formed on a lower surface of the lock arm 6 at the distal end thereof. Displacement prevention projections 8*a* for preventing the displacement of the lock arm 6 are formed integrally on the upper surface of the lock arm 6, and face away from the housing lock 8. Side spaces 4*a* for respectively receiving abutment projections 14 of the slider 10 are provided at opposite sides of the lock arm 6, respectively.

The slider 10 and the female connector 2, shown in FIG. 1, are totally identical in construction to the slider 10 and the female connector 2, respectively, and therefore the corresponding portions will be designated by identical reference numerals, respectively, and detailed description thereof will be omitted.

A buffer mechanism 40 is provided at the housing 3. When the slider 10 is returned from a non-lock position to a lock position by a resilient force of compression springs (spring members) 9, this buffer mechanism 40 abuts against the slider 10 before the lock projection 7 abuts against the slider 10, so as to absorb an impingement energy by an elastic deformation thereof.

Figure 4:
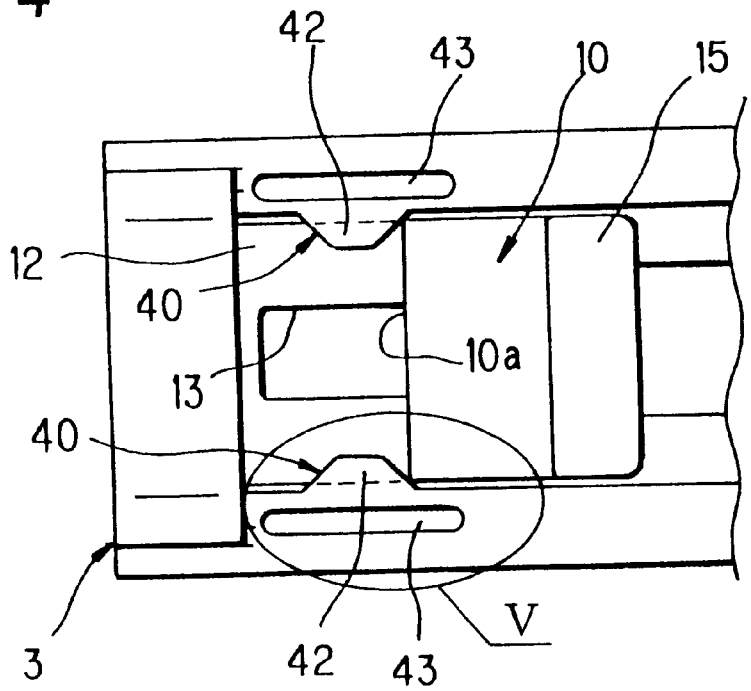
FIG. 4 is a plan view of an important portion of a male connector shown in FIG. 2.
Figure 5:
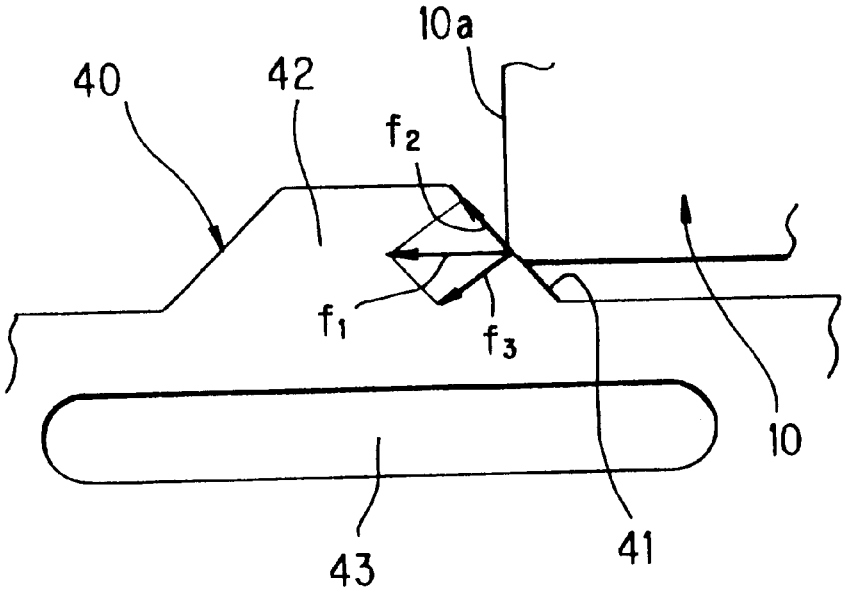
FIG. 5 is an enlarged view of a portion V of FIG. 4.
Figure 6:
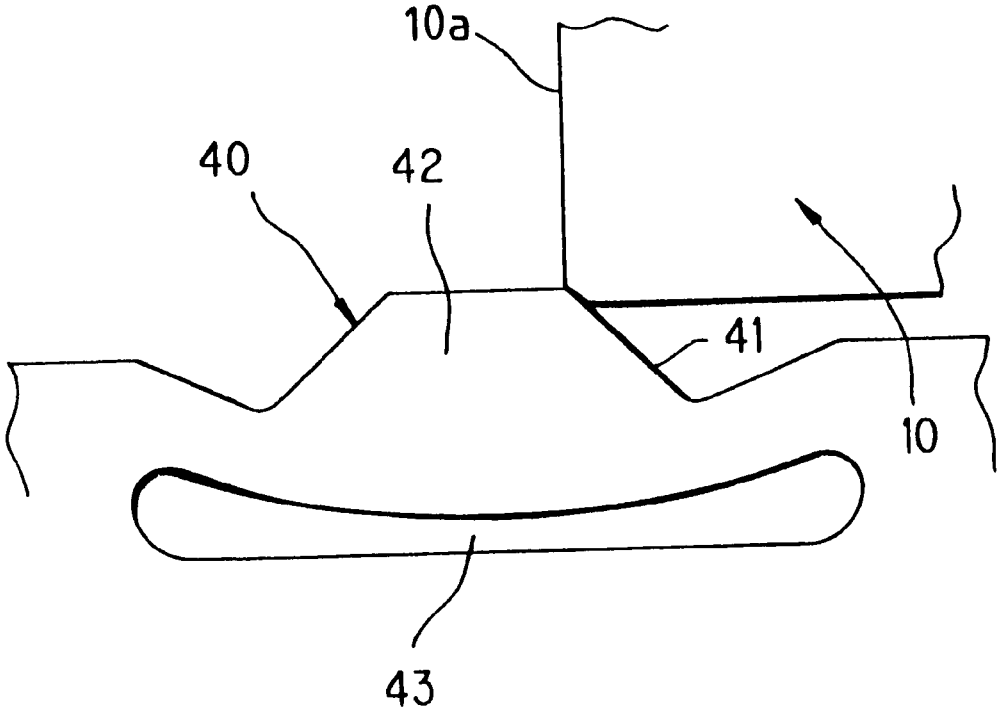
FIG. 6 is a fragmentary, enlarged view showing an elastic deformation of a buffer projection shown in FIG. 5.
Figure 7:
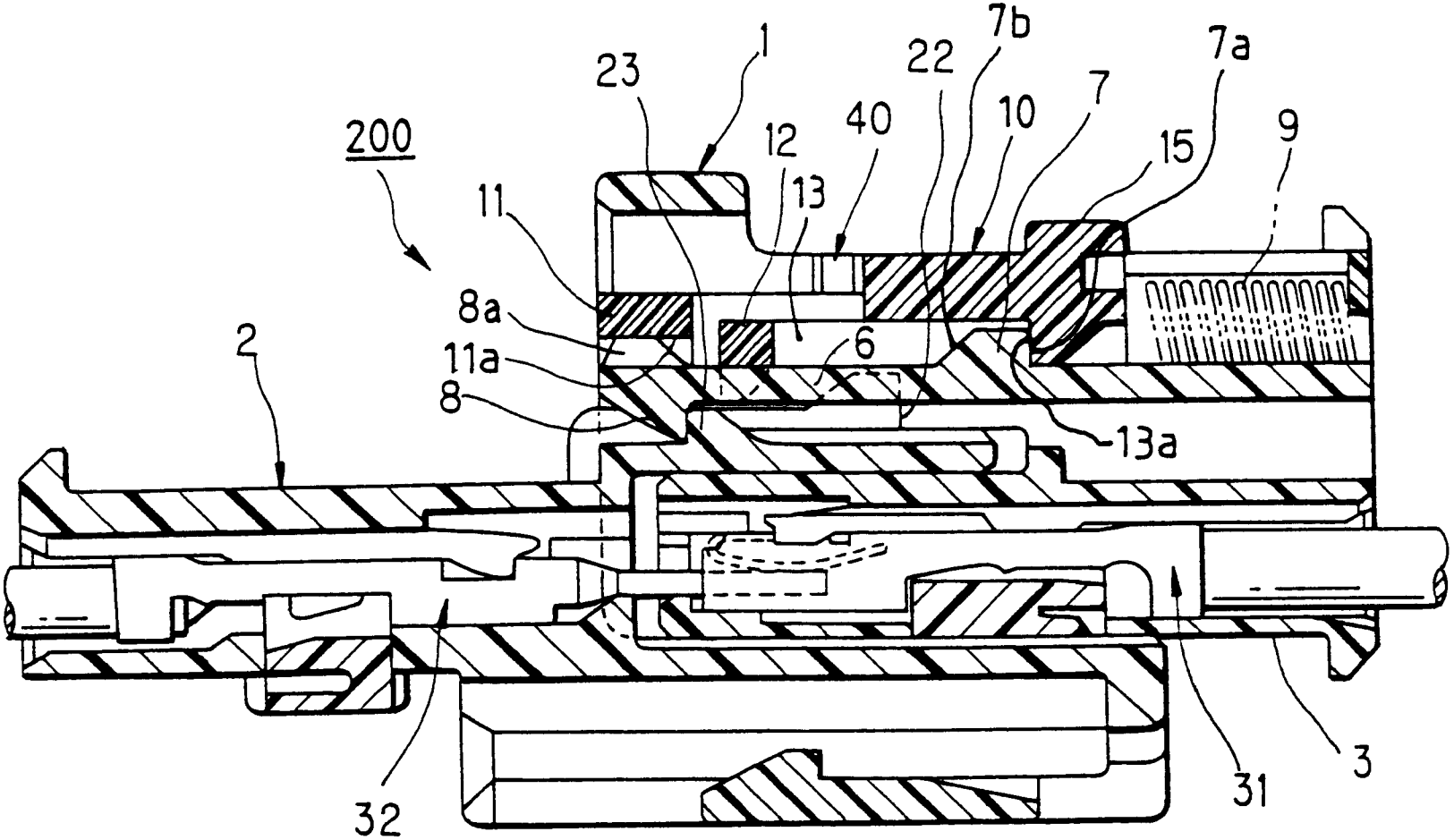
FIG. 7 is a vertical cross-sectional view of the half-fitting prevention connector of FIG. 1 in a completely-fitted condition.
Figure 8:
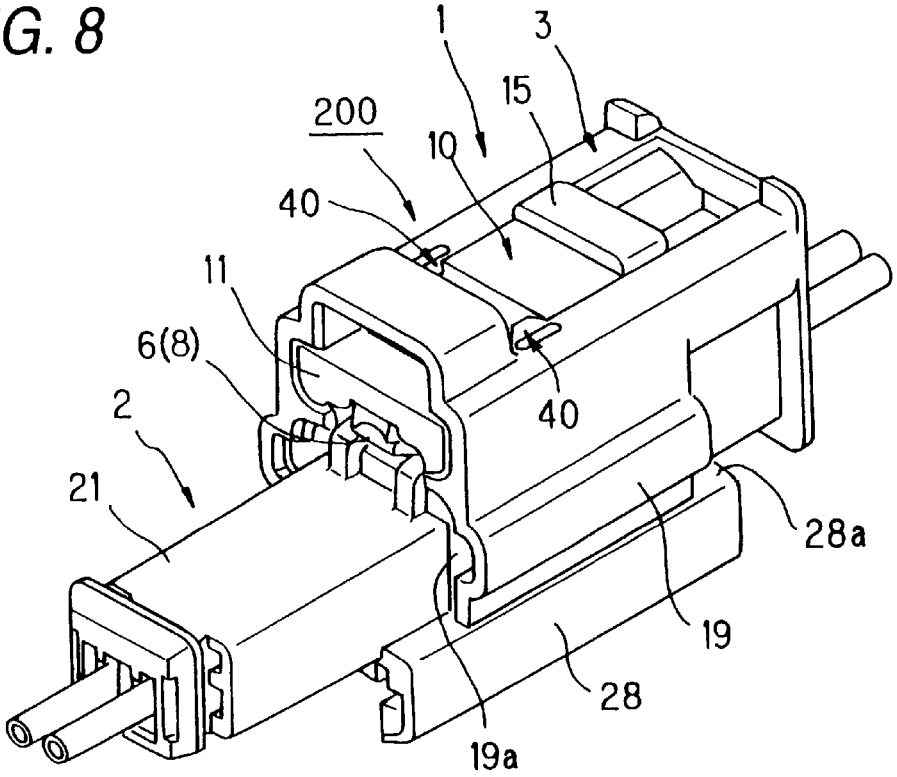
FIG. 8 is a perspective view showing the whole of the half-fitting prevention connector of FIG. 1 in the completely-fitted condition.

As shown in FIGS. 4 to 6, the buffer mechanism 40 includes buffer projections 42, formed on and projecting respectively from edges (serving respectively as slider-sliding surfaces) of upper walls of the housing 3 provided in overhanging relation to the opposite side portions of the slider receiving portion 4. The buffer mechanism 40 also includes retraction openings 43 of an elongate oval shape formed adjacent respectively to the rear sides of the buffer projections 42 so as to allow the buffer projections 42 to be elastically retracted rearwardly respectively from the slider-sliding surfaces to allow the movement of the slider 10.

As shown in FIG. 5, during the time when the slider 10 is returned to the lock position, one slanting surface 41 (directed toward the rear end (right end in FIG. 5) of the housing 3) of each buffer projection 42 of a trapezoidal shape abuts against an abutment portion 10*a* of the slider 10 at a front end thereof. The other slanting surface of the buffer projection 42 abuts against a rear end of a pressing portion 15 of the slider 10 when the slider 10 is mounted in the slider receiving portion 4.

When the slider 10 is returned to the lock position, the slanting surface 41 of the buffer projection 42 abuts against the abutment portion 10*a* at the front end of the slider 10 before an abutment surface 7*a* of the lock projection 7, formed on the lock arm 6, abuts against a rear end 13*a* of a slide groove 13 in the slider 10.

First, when the slider 10, having the compression springs 9 retained respectively by spring retaining portions 16, is inserted into the slider receiving portion 4 from the front side of the male connector 1, the slider body 11 is moved rearward along the guide grooves 5, and the abutment projections 14, formed on a lower surface of a slider arm 12, are received respectively in the side spaces 4*a* provided respectively at the opposite sides of the lock arm 6.

At this time, although the rear end of the pressing portion 15 of the slider 10, moving rearward in the slider receiving portion 4, abuts against the slanting surface (directed toward the front end (left end in FIG. 5) of the housing 3) of each buffer projection 42, the buffer projection 42 can be easily elastically retracted from the slider-sliding surface since the retraction opening 43 is formed adjacent to the rear side of the buffer projection 42.

Therefore, the slider 10 can be moved rearward in the slider receiving portion 4 while retracting the buffer projections 42 forming the buffer mechanism 40. Therefore, despite the fact that the buffer projections 42 are formed respectively on the slider-sliding surfaces, the slider 10 can be easily inserted and mounted in the housing 3.

Then, the compression springs 9 are received in the spring receiving portions 3*c*, respectively, and also the lock projection 7 is fitted in the slide groove 13, so that the slider 10 is supported on the housing 3 so as to move between the lock position and the non-lock position. In the non-lock position of the slider 10, the slider 10 is disposed at a proximal end-side of the lock arm 6 to allow the elastic deformation of the lock arm 6 when the lock arm 6 is brought into and out of engagement with the mating housing. In the lock position, the slider 10 is disposed at a distal end-side of the lock arm 6 to prevent the elastic deformation of the lock arm 6.

Figure 2:
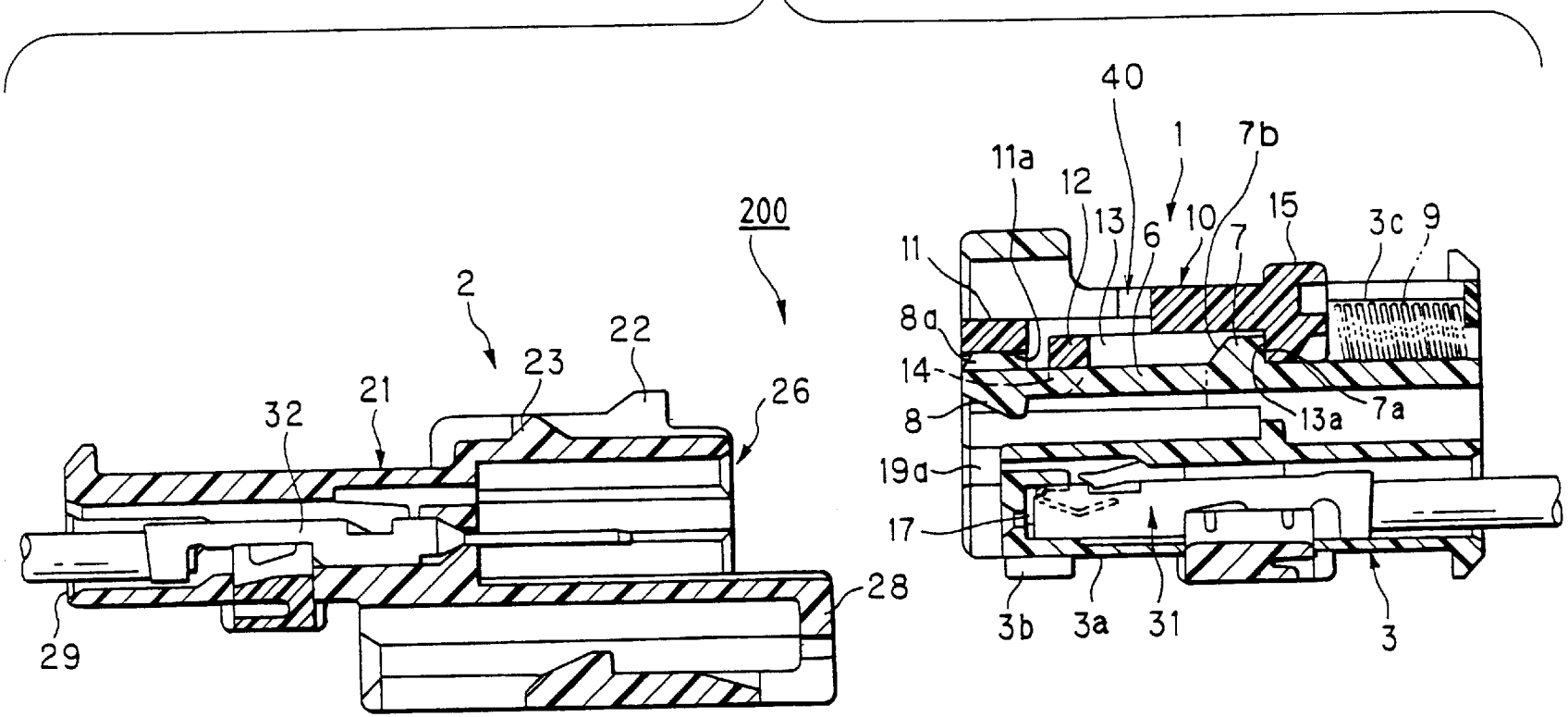
FIG. 2 is a vertical cross-sectional view showing the procedure of assembling the half-fitting prevention connector of FIG. 1.

In the slider-mounted condition, the slider 10 is urged forward (that is, to the lock position) by the resilient force of the compression springs 9 as shown in FIG. 2, and the rear end 13*a* of the slide groove 13 is engaged with the lock projection 7 in the slide groove 13, and also the displacement prevention projections 8*a* at the distal end of the lock arm 6 are abutted against a displacement prevention portion 11*a* of the slider 10, thereby preventing upward elastic displacement of the lock arm 6.

Figure 3:
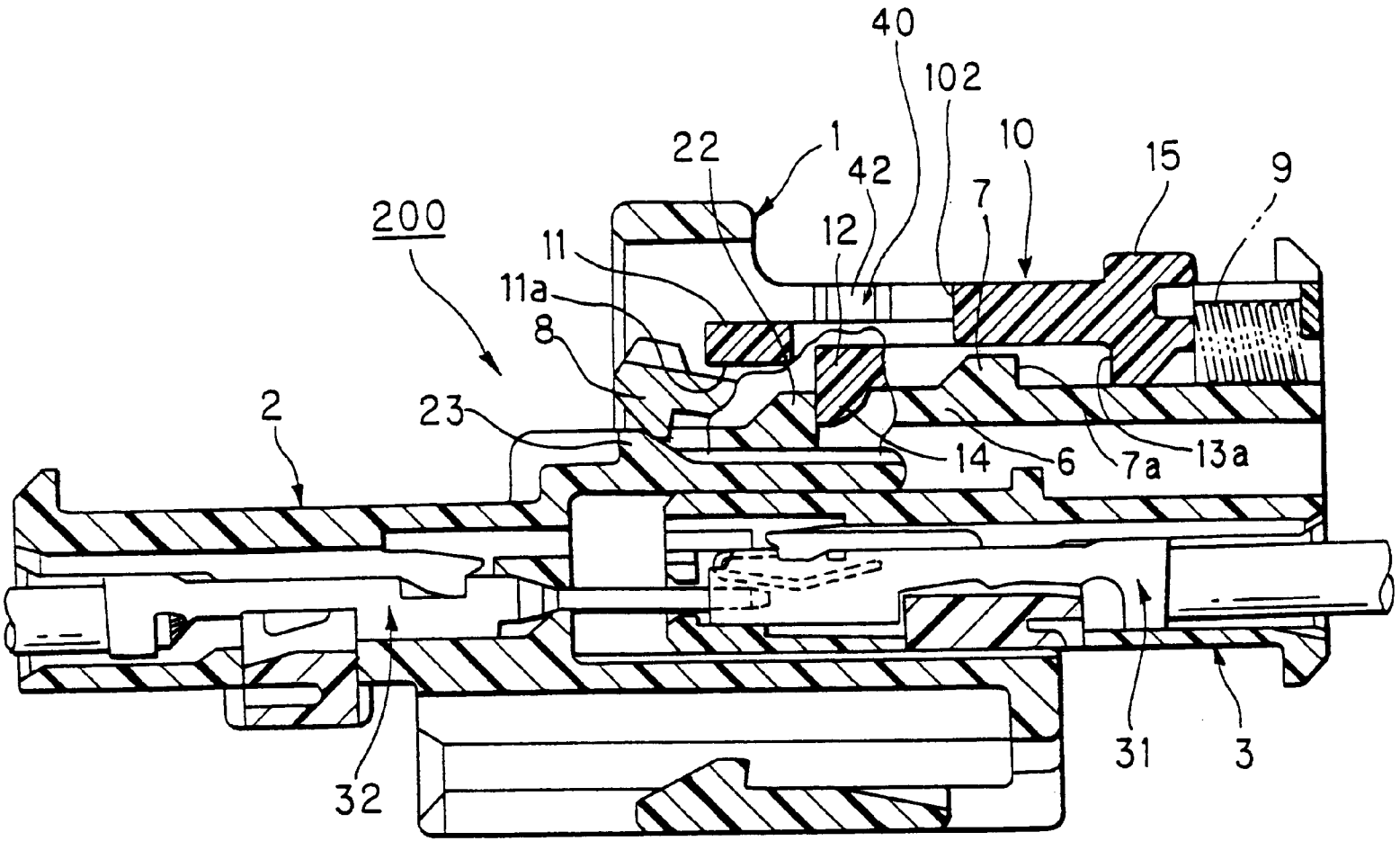
FIG. 3 is a vertical cross-sectional view showing the procedure of assembling the half-fitting prevention connector of FIG. 1.

Then, when the male and female connectors 1 and 2 begin to be fitted together as shown in FIG. 3, stopper projections 22 of the female connector 2 are inserted respectively into the side spaces 4*a* (see FIG. 1) provided respectively at the opposite sides of the lock arm 6 of the male connector 1, and these stopper projections 22 abut respectively against the abutment projections 14 of the slider 10, and when the female connector 2 is pushed, the compression springs 9 are compressed to produce a resilient force.

Then, when the fitting operation further proceeds, the slider 10 is pushed rearward (right in FIG. 3) against the bias of the compression springs 9, and the housing lock 8 at the distal end of the lock arm 6 engages an engagement projection 23 of the female connector 2. If the pushing operation is stopped in this half-fitted condition, the male and female connectors 1 and 2 are pushed back away from each other in their respective disengaging directions (opposite to their respective fitting directions) by the resilient force of the compression springs 9, so that this half-fitted condition can be easily detected.

Then, when the fitting operation further proceeds, the slider arm 12 of the slider 10 is elastically deformed upwardly by the slanting surface 7*b* of the lock projection 7, so that the abutting engagement of each stopper projection 22 with the associated abutment projection 14 of the slider 10 is canceled. Then, the housing lock 8 at the distal end of the lock arm 6 slides over the engagement projection 23, and is retained by this projection 23 while the slider arm 12, disengaged from the stopper projections 22, is returned to the lock position by the resilient force of the compression springs 9.

At this time, during the returning movement of the slider 10 to the lock position, the abutment portion 10*a* at the front end of the slider 10 abuts against the slanting surfaces 41 of the buffer projections 42 before the rear end 13*a* of the slide groove 13 abuts against the abutment surface 7*a* of the lock projection 7 formed on the lock arm 6.

Therefore, as shown in FIG. 5, an impinging force $f_1$ from the slider 10 is dissipated into a force $f_2$, acting along the slanting surface 41, and a force $f_3$ acting in a direction perpendicular to the slanting surface 41, and also each buffer projection 42 is elastically retracted rearwardly from the slider-sliding surface as shown in FIG. 6, so that the impingement energy of the slider 10 is absorbed by this elastic deformation. The retraction opening 43 is formed adjacent to the rear side of each buffer projection 42, and therefore the buffer projection 42 can be easily elastically retracted rearwardly from the slider-sliding surface, and therefore the amount of elastic deformation of the buffer projection 42 can be increased.

Then, the rear end 13*a* of the slide groove 13, formed in the slider 10 whose impingement energy has been absorbed by the buffer mechanism 40, abuts against the abutment surface 7*a* of the lock projection 7 on the lock arm 6, so that the forward displacement of the slider is prevented, and the fitting connection between the male and female connectors 1 and 2 is completed.

Therefore, in the half-fitting prevention connector 200 of this embodiment, all of the force of the compression springs 9 to return the slider 10 in the fitting operation does not serve as the force of impingement of the slider 10 on the lock projection 7 of the housing 3, and therefore an excessive force will not act on the lock projection 7, and a large impingement sound and impact vibration due to the impingement of the slider 10 on the lock projection 7 will not be produced when the slider 10 is returned.

In the half-fitting prevention connector of the present invention, the housings, the slider, the buffer mechanism and so on are not limited to their respective constructions of the above embodiment, and various modifications can be made without departing from the scope of the present invention.

Figure 9:
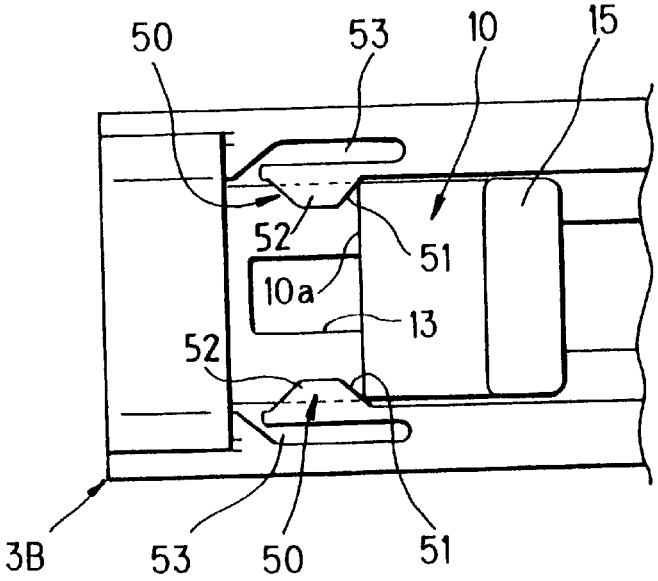
FIG. 9 is an enlarged plan view of an important portion of another embodiment of a half-fitting prevention connector of the present invention.

FIG. 9 is an enlarged plan view of an important portion of another embodiment of a half-fitting prevention connector of the present invention.

In this embodiment, a buffer mechanism 50 includes buffer projections 52, formed on and projecting respectively from edges (serving respectively as slider-sliding surfaces) of upper walls of a housing 3B provided in overhanging relation to opposite side portions of a slider receiving portion. This buffer mechanism 50 also includes retraction openings 53 formed adjacent respectively to the rear sides of the buffer projections 52 so as to allow the buffer projections 52 to be elastically retracted rearwardly respectively from the slider-sliding surfaces to allow the movement of the slider 10, and each of these retraction openings 53 is in the form of a notch-like slit.

During the returning movement of the slider 10 to the lock position, one slanting surface 51 (directed toward the rear end (right end in FIG. 9) of the housing 3B) of each buffer projection 52 of a trapezoidal shape abuts against the abutment portion 10*a* of the slider 10 at the front end thereof as described above for the buffer projection 42. The other slanting surface of the buffer projection 52 abuts against the rear end of the pressing portion 15 of the slider 10 when the slider 10 is mounted in the slider receiving portion 4. The buffer projection 52 is connected only at one end thereof to the housing 3B, and hence is supported in a cantilever manner, and therefore the amount of elastic deformation can be made larger as compared with the buffer projection 42.

In the half-fitting prevention connector of the present invention, during the returning movement of the slider from the non-lock position to the lock position by the resilient force of the spring members in the connector fitting operation, the slider abuts against the buffer mechanism before the slider abuts against the lock projection on the lock arm, so as to absorb an impingement energy by the elastic deformation of the buffer mechanism.

Therefore, when the slider subsequently abuts against the lock projection on the lock arm, the impingement is gentle since the impingement energy has been absorbed, and an excessive force is prevented from acting on the lock projection, and a large impingement sound and impact vibration due to the impingement can be reduced.

Therefore, there can be provided the improved half-fitting prevention connector in which undue impingement of the slider on the housing is prevented at the time of returning movement of the slider, thereby reducing unpleasant impingement sound and impact vibration due to the impingement.

What is claimed is:

1. A half-fitting prevention connector, comprising:

a first connector housing having a lock arm formed therein, the lock arm including a lock projection;

a second connector housing fittable to the first connector housing;

a resilient member attachable into the first connector housing;

a slider insertable into the first connector housing, the slider preventing a half-fitted condition of the first and second connector housings by a resilient force of the resilient member, wherein when the first and second connector housings are fitted to each other, the slider cooperates with the resilient member to move between a lock position where the slider holds the lock arm in retained relation to the second connector housing and a non-lock position, and the lock projection of the lock arm retains the slider in the lock position against the resilient force of the resilient member; and an elastic buffer mechanism provided at the first connector housing, wherein, during returning movement of the slider from the non-lock position to the lock position by the resilient force of the resilient member, the buffer mechanism abuts against the slider before the lock projection abuts against the slider, so as to absorb an impingement energy by an elastic deformation thereof.

2. A half-fitting prevention connector according to claim 1, wherein the buffer mechanism includes:

buffer projections formed on and projecting respectively from slider-sliding surfaces which are formed in the first connector housing, and on which the slider is slidable, each of the buffer projections having a slanting surface for abutting engagement with the slider, and retraction openings formed adjacent respectively to rear sides of the buffer projections so as to allow the buffer projections to be elastically retracted rearwardly respectively from the slider-sliding surfaces to allow the movement of the slider.

* * * * *